US006186837B1

(12) United States Patent
Abe

(10) Patent No.: US 6,186,837 B1
(45) Date of Patent: Feb. 13, 2001

(54) CONNECTOR TERMINAL

(75) Inventor: Kimihiro Abe, Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/090,415

(22) Filed: Jun. 4, 1998

(30) Foreign Application Priority Data

Jun. 12, 1997 (JP) ..... 9-155329

(51) Int. Cl.[7] ..... H01R 13/432
(52) U.S. Cl. ..... 439/748; 439/746; 439/872
(58) Field of Search ..... 439/746, 748, 439/749, 872, 744, 747

(56) References Cited

U.S. PATENT DOCUMENTS

| | | | | |
|---|---|---|---|---|
| 4,620,766 | | 11/1986 | Leonard | 339/217 |
| 4,726,792 | | 2/1988 | Shindo | 439/748 |
| 4,880,401 | * | 11/1989 | Shima et al. | 439/746 |
| 5,609,502 | * | 3/1997 | Thumma | 439/746 |
| 5,624,273 | * | 4/1997 | Myer | 439/748 |
| 5,664,969 | * | 9/1997 | Peterson et al. | 439/746 |
| 5,911,603 | * | 6/1999 | Mansutti | 439/748 |

FOREIGN PATENT DOCUMENTS 2-299176 11/1990 (JP) ..... H01R/13/502

* cited by examiner

*Primary Examiner*—Paula Bradley
*Assistant Examiner*—Katrina Davis
(74) *Attorney, Agent, or Firm*—Sughrue, Mion, Zinn, Macpeak & Seas, PLLC

(57) ABSTRACT

In a terminal, an resilient locking piece (24) is protruded from an upper surface of a terminal (17). The resilient locking piece (24) includes an engaging portion (25) formed at a central portion thereof, and a pair of abutting portions (26) formed on opposite sides of the engaging portion (25). The engaging portion (25) is engaged with a locking hole formed in a connector housing, while the abutting portions (26) are abutted against a surface of the connector housing which is located at a periphery of the locking-hole. Therefore, even if the terminal is pulled outwardly from the connector housing, the resilient locking piece (24) is prevented from being bent backwardly because of the presence of the abutting portions (26). That is, the terminal (17) is securely held in the connector housing without play.

38 Claims, 5 Drawing Sheets

CONNECTOR TERMINAL

BACKGROUND OF THE INVENTION

1. Field of the Invention

This invention relates to a connector terminal which is inserted into a connector housing and is retained in the connector housing.

2. Background

FIG. 5 shows a terminal 1 disclosed by Unexamined Japanese Patent Publication No. Hei. 2-299176.

The terminal 1 includes: a contact section 2 having a pair of contact pieces 2*a* and 2*b* which are resiliently brought into contact with an end portion of a terminal of a mating connector from the above and below; a press-connecting section 3 to which a covered wire is press-connected to electrically connect; and a clamping section 4 adapted to clamp the covered wire to fix the covered wire. Thus, in the terminal 1, the contact section 2, the press-connecting section 3, and the clamping section 4 are arranged in the stated order. The upper contact piece 2*a* has a resilient locking piece 5 which is formed by cutting and raising a part of the contact piece 2*a*. The resilient locking piece 5 is used to prevent the terminal 1 from coming off the connector housing.

FIGS. 6*a* to 6*c* show a process of mounting the terminal 1 onto a connector housing 6.

The connector housing 6 includes an upper wall 7, a lower wall 8, a front end wall 9, and side walls 10. Those walls 7 through 10 form a terminal receiving chamber into which the terminal 1 is insertable. The upper wall 7 has a locking hole 12 which extends through the upper wall 7 in a thickness direction. The locking piece 5 is locked to the locking hole 12. A diameter of the locking hole 12 is equal or slightly larger than the width of the locking piece 5. Thus, the locking piece 5 engages with the locking hole 12 while being inserted in the locking hole 12. The front end wall 9 has a terminal inserting hole 12 into which a terminal of a mating connector is insertable.

As shown in FIG. 6*a*, the terminal 1 is placed in the connector housing 6 from a rear of the upper wall 7. Then, as shown in FIG. 6*b*, a jig 14 is used so that the terminal 1 is inserted into the terminal receiving chamber 11 while being slid on the upper surface of the lower wall 8. This insertion causes the contact section 2 of the terminal to confront directly with the terminal inserting hole 13. At this time, the resilient locking piece 5 engages with the locking hole 12 of the upper wall 7 so as to prevent a rearward withdrawal of the terminal 1 from the connector housing 6.

Thereafter, as shown in FIG. 6*c*, the covered wire 15 is pressed so that the press-connecting section 3 is electrically connected to the conductor of the covered wire 15. Under this condition, the rear end portion of the connector housing 6 is covered with a cover plate 16.

When it is required to remove the terminal 1 from the connector housing 6, a jig is inserted into the locking hole 12 to push down the resilient locking piece 5 until that the resilient locking piece 5 can be disengaged from the locking hole 12.

The terminal 1, however, may be relatively readily disengaged from the connector housing 6 when the terminal 1 is pulled axially. This operation will now be described with reference to FIGS. 7*a* and 7*b*. As shown in FIG. 7*a*, when the terminal 1 is pulled in the direction of the arrow D, the resilient locking piece 5 is abutted against the inner surface of the locking hole 12. When the terminal 1 is further pulled in the same direction, the resilient locking piece 5 is warped upwardly along the inner surface of the locking hole 12 as shown in FIG. 7*b*. Accordingly, the terminal 1 is pulled out in the direction of tension. As described above, the terminal is not positively held in the connector housing sufficiently. Thus, the structure of the terminal is low in reliability.

SUMMARY OF THE INVENTION

In order to eliminate the above problem, an object of the invention is to provide a terminal which is securely held in the connector housing without play.

To achieve the above object, there is provided a terminal insertable into a connector housing having a locking hole, which comprises: an electrically conductive body including a wire connecting section to which a wire is connectable, and an electric contact section with which another terminal is matable; a resilient locking piece protruded from an outer surface of the electrically conductive body; an engaging portion formed on the resilient locking piece, the engaging portion being engaged with the locking hole of the connector housing; and abutting portions formed on the resilient locking piece, the abutting portions abutting against a surface of the connector housing which is located at a periphery of the locking hole.

In the terminal, the engaging portion of the resilient locking piece is engaged with the locking hole of the connector housing, to prevent a rearward withdrawal of the terminal from the connector housing. By pushing the engaging portion downwardly with a jig inserted into the locking hole, the engaging portion is disengaged from the locking hole, so that the terminal may be pulled out of the connector housing.

The abutting portions of the resilient locking piece are not insertable into the locking hole, and abut against the surface located at the periphery of the locking-hole. Therefore, even if the terminal is pulled outwardly, the abutting portions will not go into the locking hole; that is, the abutting portions are kept abutting against the surface. Accordingly, since an upward movement of the resilient locking piece is prevented even if the terminal is pulled outwardly, the terminal is securely held by the connector housing without play.

Preferably, the engaging portion has a width which is substantially equal to a diameter of the locking hole, and the resilient locking piece has a width which is larger than the diameter of the locking hole. Furthermore, the abutting portions and the engaging portion are provided to form steps on the resilient locking piece.

In the terminal, the width of the engaging portion is substantially equal to the diameter of the locking hole, and therefore the engaging portion is inserted into the locking hole and is engaged with the locking hole. On the other hand, the width of the resilient locking piece is larger than the diameter of the locking hole. Therefore, all the resilient locking piece cannot go into the locking hole, and the abutting portions, which form steps with the engaging portion, are abutted against the surface located at the periphery of the locking-hole. This feature prevents the resilient locking piece from moving upwardly; that is, the terminal can be securely held in the connector housing. Since the abutting portions are provided to form the steps with the engaging portion, the engaging portion can be engaged with the locking hole without being interfered by the abutting portion.

Preferably, the abutting portions extends in a width direction of the engaging portion, respectively. The abutting portions and the engaging portion are formed stepwise on the resilient locking piece, the abutting portions are formed on opposite sides of the engaging portion, respectively.

In the terminal, the abutting portions are provided on the opposite sides of the engaging portion, and therefore they are abutted against the surface located at the periphery of the locking hole on both sides of the engaging portion when the engaging portion is engaged with the locking hole. Accordingly, the abutment of the abutting portions is stable, and the terminal is securely held in the connector housing.

DETAILED DESCRIPTION OF THE PREFERRED EMBODIMENTS

First Embodiment

A first embodiment of the invention will now be described with reference to FIGS. 1 through 3.

Figure 1:
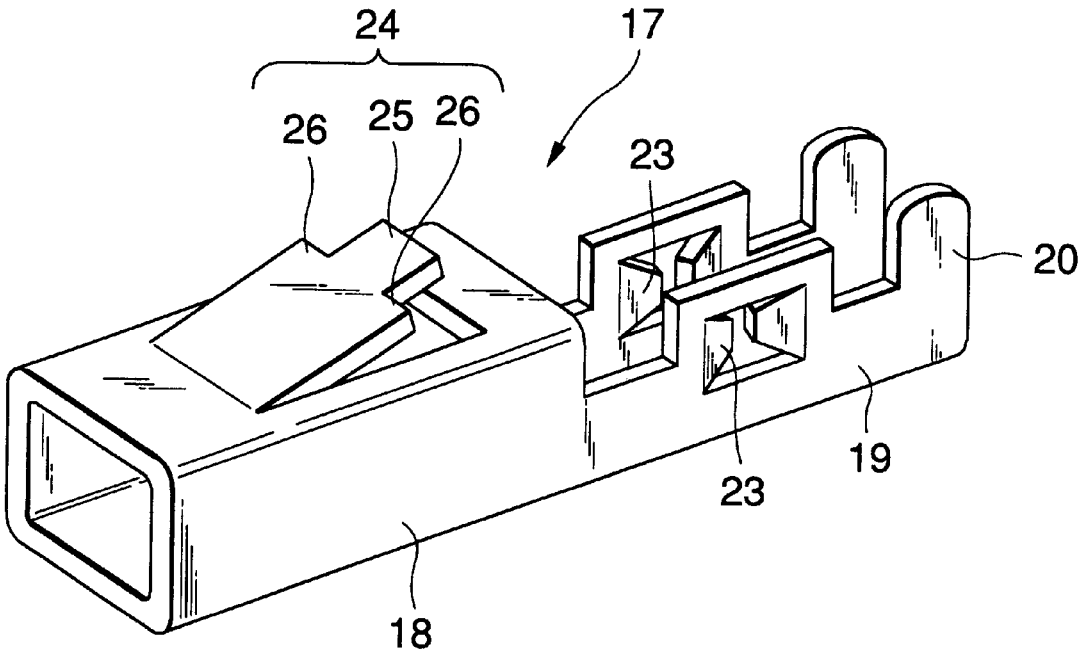
FIG. 1 is a perspective view showing an example of a terminal according to a first embodiment of the invention.

A terminal 17 is shaped as shown in FIG. 1 by blanking and pressing an electrically conductive plate. The terminal 17 includes: a contact section 18 which is formed at a front end portion of the terminal 17; a press-connecting section 19 which is formed at a portion following the contact section 18; and a clamping section 20 which is formed at a rear end portion following the press-connecting section 19. As shown in FIG. 2, the terminal 17 is inserted into a connector housing 21 and is confronted with a terminal inserting hole 22 of the connector housing 21. Thus, the terminal 17 can be brought into contact with an end portion of a terminal of a mating connector which is inserted into the connector housing 21 through the terminal inserting hole 22.

The press-connecting section 19 has two pairs of press blades 23. Each of the press blades 23 is formed by cutting and raising a part of the press-connecting section 19, in such a manner that the two pairs of the press blades 23 are symmetrically arranged with each other. A covered wire is pressed-connected in between the two pairs of the press blades 23, so that the press blades 23 are electrically connected to the conductor of the covered wire. That is, the terminal 17 is electrically connected to the conductor of the covered wire. The clamping section 20 is adapted to clamp the covered wire thus press-connected, so that the covered wire is positively held.

Figure 2:
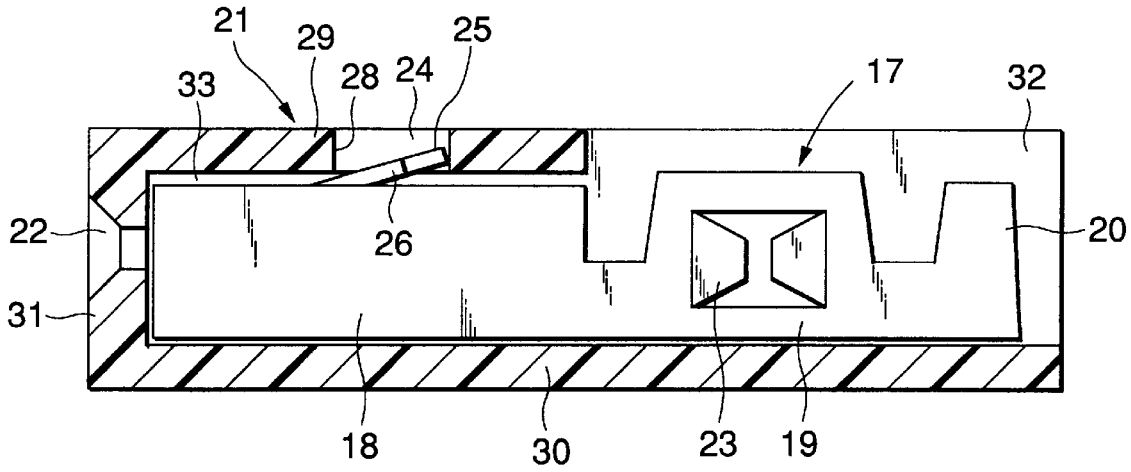
FIG. 2 is a sectional view showing the terminal set in a connector housing.

As shown in FIG. 2, the connector housing 21 includes an upper wall 29, a lower wall 30, a front end wall 31 and side walls 32. Those walls 29, 30, 31 and 32 form a terminal receiving chamber 33 into which the terminal 17 is insertable. A locking hole 28 extends through the upper wall 29 in a thickness direction of the upper wall 29. The terminal 17 is inserted into the terminal receiving chamber 33 from a rear of the connector housing 21.

As shown in FIG. 1, the terminal 17 has a resilient locking piece 24. The resilient locking piece 24 is formed by cutting and raising a part of an upper surface of the contact section 18 in such a manner that the locking piece 24 is protruded from the upper surface of the contact section 18. More specifically, the resilient locking piece 24 is formed by cutting and raising a part of the upper surface of the contact section 18 in such a manner that the height of the locking piece 24 is gradually larger towards the press-connecting section 19 so that the terminal 17 is smoothly insertable into the connector housing 21.

An engaging portion 25 is formed at a middle of the end portion of the resilient locking piece 24. The engaging portion 25 is engaged with the locking hole 28 formed in the upper wall 29 of the connector housing 21. The resilient locking piece 24 has shoulders, i.e. abutting portions 26 and 26 on opposite sides of the engaging portion 25. The abutting portions 26 and 26 are formed stepwise with respect to the engaging portion 25. The abutting portions 26 and 26 abut against peripheral portions of the locking hole 28 of the upper wall 29 of the connector housing 21.

Figure 3A:
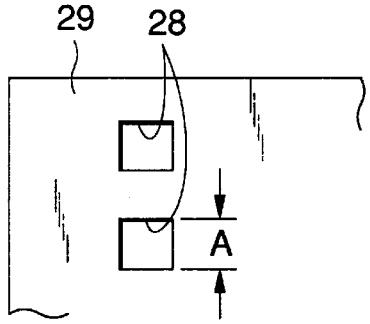
FIG. 3*a* is a plan view showing dimensions of a locking hole.
Figure 3B:
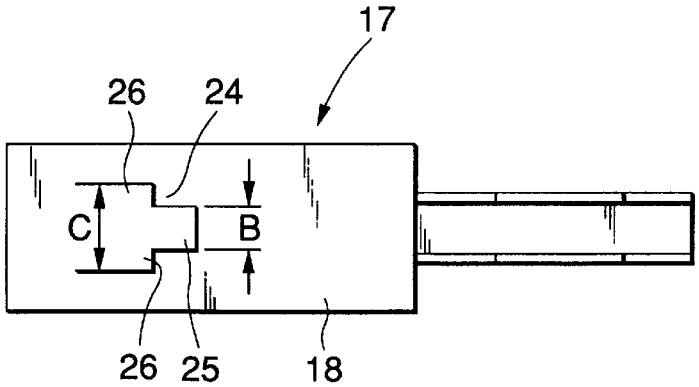
FIG. 3*b* is a plan view showing dimensions of a resilient locking piece.

FIGS. 3*a* and 3*b* show the dimensions of the engaging portion 25, the abutting portion 26, and the locking hole 28. More specifically, FIG. 3*a* shows the locking hole 28 formed in the upper wall 29 of the connector housing 21, and FIG. 3*b* shows the terminal 17. The locking hole is a rectangular hole whose one side is A in length. On the other hand, the width B of the engaging portion 25 is substantially equal to the length A of the locking hole 28; i.e., $$A \approx B.$$

Therefore, the engaging portion 25 can be inserted into the locking hole 28 of the connector housing 21. Accordingly, the engaging portion 25 can be engaged with the locking hole 28.

The sum C of the widths of the engaging portion 25 and the abutting portions 26; that is, the width C of the resilient locking piece 24 is larger than the length A; i.e., $$A < C.$$

Therefore, all the resilient locking piece 24 cannot be inserted into the locking hole 28. More specifically, the abutting portion 26 abut against the peripheral portions of the locking hole 28 of the upper wall 29 of the connector housing 21. Accordingly, even if a force is applied to the terminal 17 to pull the terminal 17 out of the connector housing 21, since the abutting portions 26 are kept abutted against the upper wall 29, the resilient locking piece 24 is prevented from being moved upwardly. That is, the terminal 17 is securely held in the connector housing, thereby the mounting of the terminal in the connector housing is high in reliability.

In the above-described embodiment, the abutting portions 26 are provided on the opposite sides of the engaging portion 25, and the abutting portions 26 abut against the upper wall 29 of the connector housing 21 on the opposite sides of the locking hole 28. Hence, the abutment is stable, and the terminal 17 is securely held in the connector housing.

Second Embodiment

Figure 4:
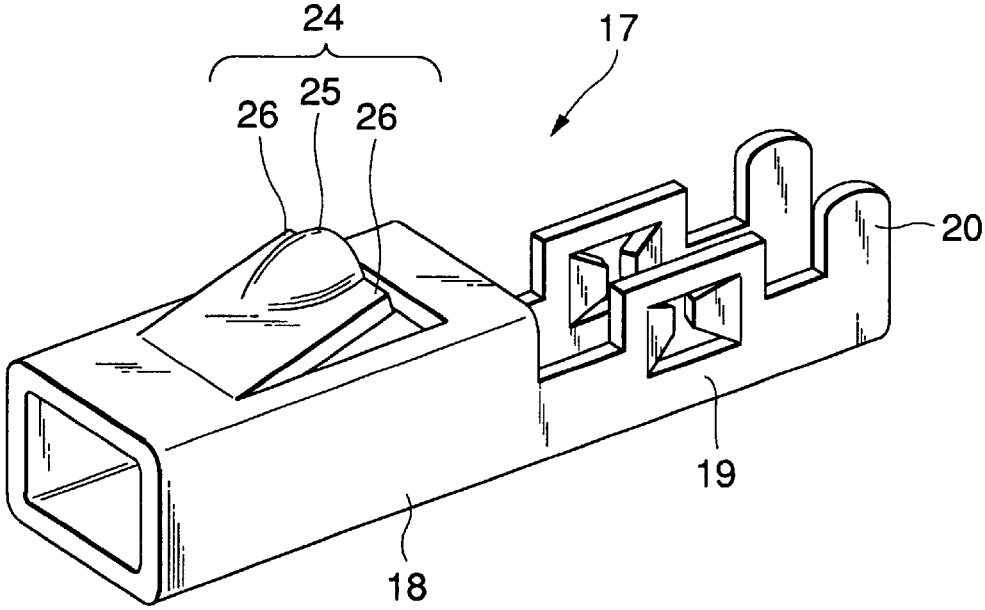
FIG. 4 is a perspective view showing a terminal according to a second embodiment of the invention.
Figure 5:
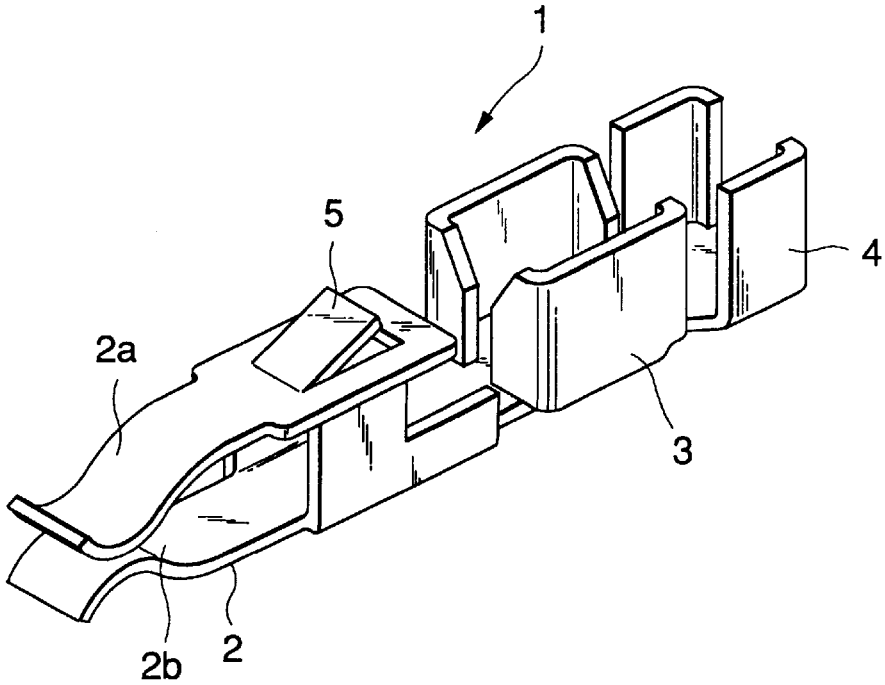
FIG.5 PRIOR ART
FIG. 5 is a perspective view showing the terminal disclosed by Unexamined Japanese Patent Publication No. Hei. 2-299176.
Figure 6A:
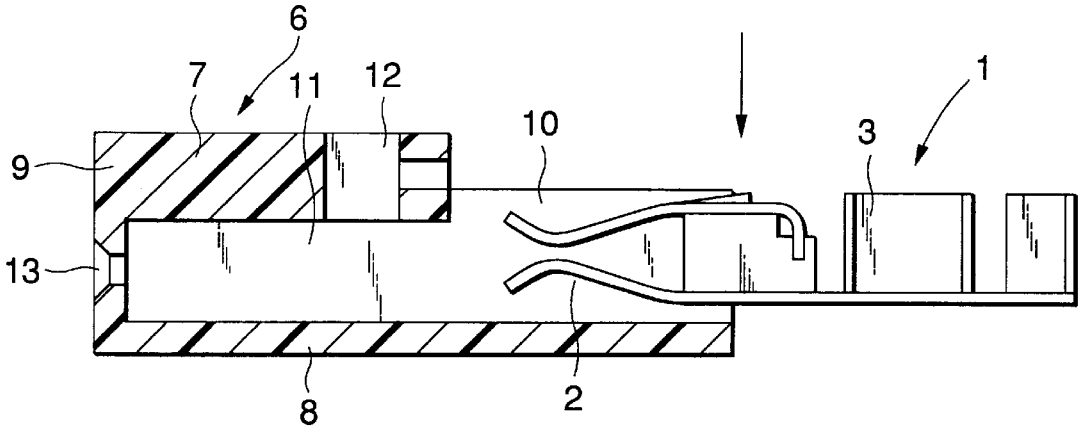
FIG.6a PRIOR ART
FIGS. 6*a* to 6*c* are sectional views illustrating a procedure of setting the terminal of FIG. 5 in a connector housing.
Figure 6B:
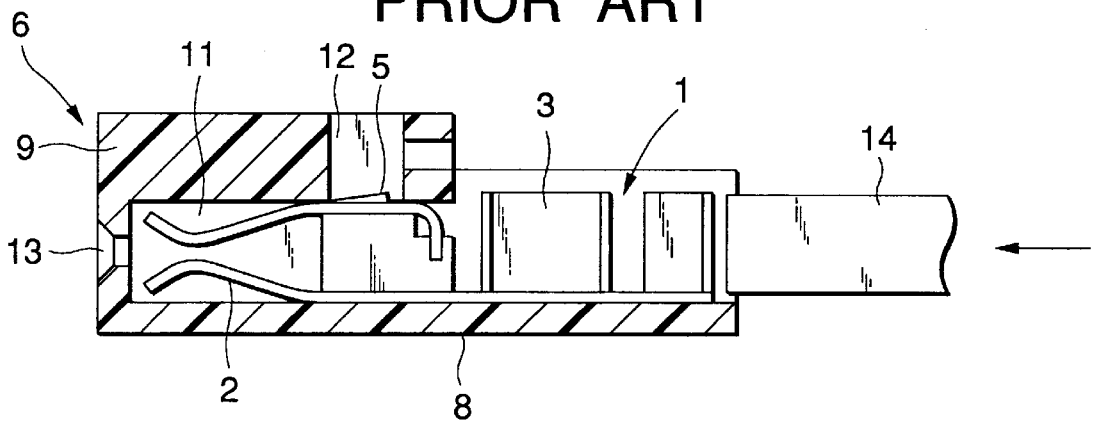
FIG.6b PRIOR ART
Figure 6C:
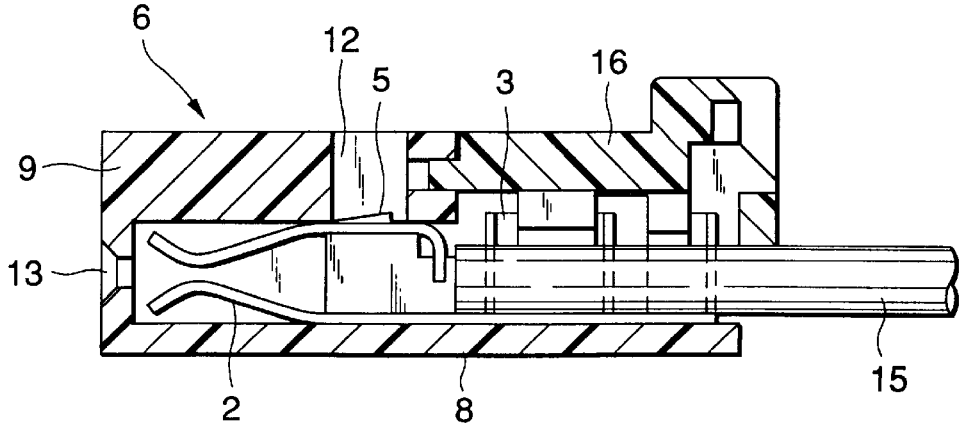
FIG.6c PRIOR ART
Figure 7A:
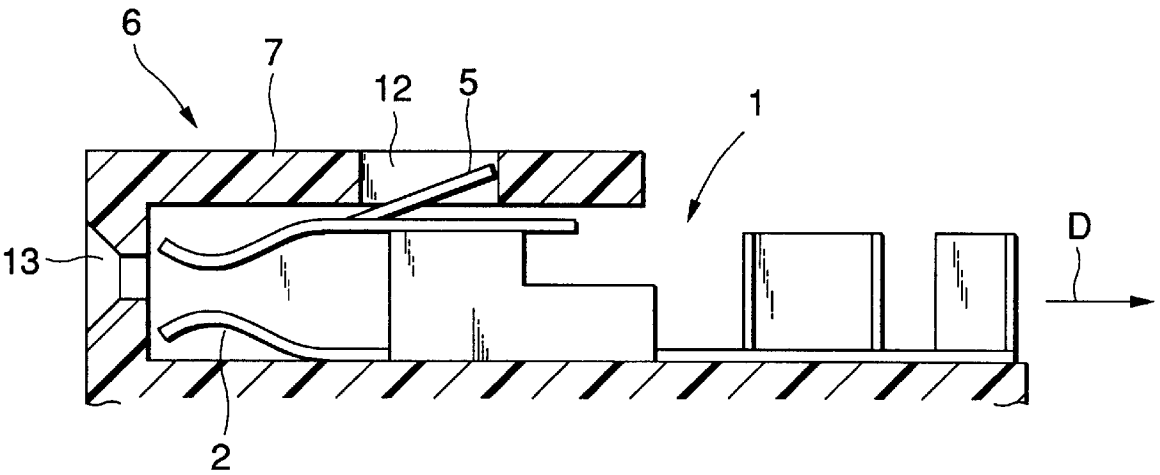
FIG.7a PRIOR ART
FIG. 7*a* and 7*b* are diagrams illustrating problems involved in the terminal of FIG. 5.
Figure 7B:
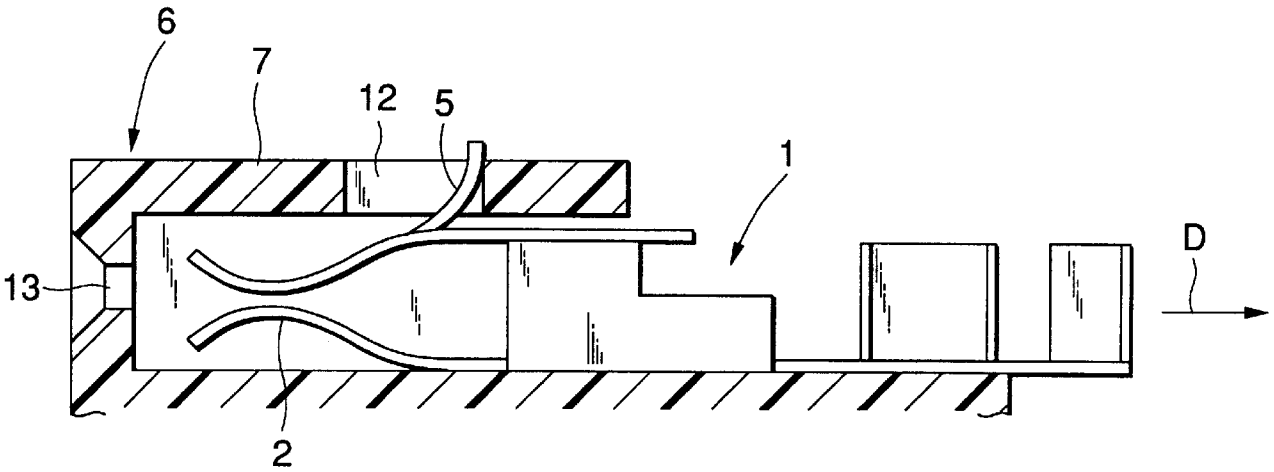
FIG.7b PRIOR ART

FIG. 4 shows another example of the terminal, which is a second embodiment of the invention. In FIG. 4, parts corresponding to those already described with reference to the above-described first embodiment are therefore designated by the same reference numerals or characters.

In the second embodiment, the resilient locking piece 24 has an engaging portion 25 curved upwardly at the central portion. The upper part of the engaging portion 25 thus upwardly curved is engaged with the locking hole 28, and therefore the abutting portions 26, which are extended from the lower edge of the engaging portion, are spaced from the locking hole 28. This feature positively prevents the abutting portions 26 from going in the locking hole 28. Thus, the resilient locking piece 24 securely holds the terminal 17 in the connector housing.

What is claimed is:

1. A terminal insertable into a connector housing having a locking hole, comprising:

an electrically conductive body including a wire connecting section to which a wire is connectable, and an electric contact section with which another terminal is matable;

a resilient locking piece projecting from an outer surface of the electrically conductive body;

an engaging portion formed on the resilient locking piece, the engaging portion being engaged with the locking hole of the connector housing; and abutting portions formed on the resilient locking piece, the abutting portions abutting against an inside surface of the connector housing which is located at a periphery of the locking hole.

2. The terminal of claim 1, wherein the engaging portion has a width which is substantially equal to a diameter of the locking hole, and the resilient locking piece has a width which is larger than the diameter of the locking hole.

3. The terminal of claim 1, wherein the abutting portions and the engaging portion form steps on the resilient locking piece.

4. The terminal of claim 1, wherein the abutting portions extends in a width direction of the engaging portion, respectively.

5. The terminal of claim 1, wherein the abutting portions and the engaging portion are formed stepwise on the resilient locking piece, the abutting portions are formed on opposite sides of the engaging portion, respectively.

6. The terminal of claim 1, wherein said abutting portions are defined by stepped portions which are stepped in relation to said engaging portion.

7. The terminal of claim 1, wherein said engaging portion includes a dimple provided in said resilient lock piece.

8. The terminal of claim 1, wherein said abutting portions are respectively disposed on opposite sides of said engaging portion and wherein the distance between opposite lateral sides of said abutting portions is greater than a width of said engaging portion.

9. The terminal of claim 1, wherein said abutting portions are stepped back from said engaging portion.

10. The terminal of claim 1, wherein said abutting portions are defined by a notch.

11. The terminal of claim 1, wherein said abutting portions are prevented from passing through said locking hole.

12. A connector terminal adapted to be insertable into a connector housing having a locking hole, comprising:

an electrically conductive body including a wire connecting section and an electric contact section; and a resilient locking piece projecting from an outer surface of the electrically conductive body, said resilient locking piece including an engaging portion and at least one abutting portion, wherein said engaging portion is disposed to engage the locking hole in the connector housing, and wherein said at least one abutting portion is disposed to abut against an inside surface of the connector housing proximate said locking hole.

13. The connector terminal of claim 12, where said at least one abutting portion is prevented from passing through said locking hole.

14. The connector terminal of claim 12, wherein said engaging portion has a width no greater than a width of the locking hole.

15. The connector terminal of claim 14, wherein a width of said resilient locking piece at a portion including said at least one abutting portion is greater than a width of the locking hole.

16. The connector terminal of claim 15, wherein said at least one abutting portion is substantially perpendicular to and coplanar with said engaging portion.

17. The connector terminal of claim 15, wherein said engaging portion extends outwardly from an upper surface of said resilient locking piece.

18. The connector terminal of claim 17, wherein said engaging portion has a curved surface.

19. The connector terminal of claim 12, further comprising another abutting portion on said resilient locking piece, wherein one abutting portion is disposed on each side of the engaging portion.

20. The connector terminal of claim 19, wherein said abutting portions are defined by stepped portions which are stepped in relation to said engaging portion.

21. The connector terminal of claim 19, wherein said engaging portion includes a dimple provided in said resilient lock piece.

22. The connector terminal of claim 19, wherein said abutting portions are disposed on opposite sides of said engaging portion and wherein the distance between opposite lateral sides of said abutting portions is greater than a width of said engaging portion.

23. The connector terminal of claim 19, wherein said abutting portions are stepped back from said engaging portion.

24. The connector terminal of claim 19, wherein said abutting portions are defined by a notch.

25. A terminal in combination with a connector housing having a locking hole, said terminal being insertable into said connector housing and comprising:

an electrically conductive body including a wire connecting section to which a wire is connectable, and an electric contact section with which another terminal is matable;

a resilient locking piece projecting from an outer surface of the electrically conductive body;

an engaging portion formed on the resilient locking piece, the engaging portion being engaged with the locking hole of the connector housing; and abutting portions formed on the resilient locking piece, the abutting portions abutting against an inside surface of the connector housing which is located at a periphery of the locking hole.

26. The terminal of claim 25, wherein the engaging portion has a width which is substantially equal to a diameter of the locking hole, and the resilient locking piece has a width which is larger than the diameter of the locking hole.

27. The terminal of claim 25, wherein the abutting portions and the engaging portion form steps on the resilient locking piece.

28. The terminal of claim 25, wherein the abutting portions extends in a width direction of the engaging portion, respectively.

29. The terminal of claim 25, wherein the abutting portions and the engaging portion are formed stepwise on the resilient locking piece, and wherein the abutting portions are formed on opposite sides of the engaging portion, respectively.

30. The terminal of claim 25, wherein said abutting portions are prevented from passing through said locking hole.

31. A connector terminal in combination with the connector housing having a locking hole, said connector terminal being insertable into said connector housing and comprising;

an electrically conductive body including a wire connecting section and an electric contact section; and a resilient locking piece projecting from an outer surface of the electrically conductive body, said resilient locking piece including an engaging portion and at least one abutting portion, wherein said engaging portion is disposed to engage the locking hole in the connector housing, and wherein said at least one abutting portion is disposed to abut against an inside surface of the connector housing proximate said locking hole such that said at least one abutting portion is prevented from passing through said locking hole.

32. The connector terminal of claim 31, wherein said engaging portion has a width no greater than a width of the locking hole.

33. The connector terminal of claim 31, wherein a width of said resilient locking piece at a portion including said at least one abutting portion is greater than a width of the locking hole.

34. The connector terminal of claim 31, wherein said at least one abutting portion is substantially perpendicular to and coplanar with said engaging portion.

35. The connector terminal of claim 31, wherein said engaging portion extends outwardly from an upper surface of said resilient locking piece.

36. The connector terminal of claim 31, wherein said engaging portion has a curved surface.

37. The connector terminal of claim 31, further comprising a second abutting portion on said resilient locking piece such that said connector terminal includes first and second abutting portions which are disposed on opposite sides of the engaging portion, respectively.

38. The connector terminal of claim 31, wherein said at least one abutting portion is prevented from passing through said locking hole.

* * * * *